US009147975B2

(12) United States Patent
Shiratori et al.

(10) Patent No.: US 9,147,975 B2
(45) Date of Patent: Sep. 29, 2015

(54) CONNECTOR

(75) Inventors: Masayuki Shiratori, Tokyo (JP); Kentaro Toda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 56 days.

(21) Appl. No.: 14/001,730

(22) PCT Filed: Jan. 6, 2012

(86) PCT No.: PCT/JP2012/050149
§ 371 (c)(1),
(2), (4) Date: Aug. 27, 2013

(87) PCT Pub. No.: WO2012/144239
PCT Pub. Date: Oct. 26, 2012

(65) Prior Publication Data

US 2013/0337663 A1 Dec. 19, 2013

(30) Foreign Application Priority Data

Apr. 18, 2011 (JP) ..... 2011-092067

(51) Int. Cl.
*H01R 13/64* (2006.01)
*H01R 13/6471* (2011.01)
*H01R 12/72* (2011.01)

(52) U.S. Cl.
CPC ..... *H01R 13/6471* (2013.01); *H01R 12/724* (2013.01)

(58) Field of Classification Search
CPC ..... H01R 13/6471
USPC ..... 439/79
See application file for complete search history.

(56) References Cited

U.S. PATENT DOCUMENTS

| | | | | |
|---|---|---|---|---|
| 5,224,867 | A * | 7/1993 | Ohtsuki et al. | 439/108 |
| 6,863,549 | B2 * | 3/2005 | Brunker et al. | 439/108 |
| 6,935,870 | B2 * | 8/2005 | Kato et al. | 439/108 |
| 7,270,570 | B1 * | 9/2007 | Hamner et al. | 439/607.04 |
| 7,435,107 | B2 * | 10/2008 | Masumoto et al. | 439/79 |
| 7,448,884 | B2 * | 11/2008 | Kato et al. | 439/108 |
| 7,462,059 | B2 * | 12/2008 | Saito et al. | 439/397 |
| 7,674,118 | B2 * | 3/2010 | He | 439/108 |
| 7,824,198 | B2 * | 11/2010 | Tanaka | 439/108 |

(Continued)

FOREIGN PATENT DOCUMENTS

| | | |
|---|---|---|
| JP | A-H04-230969 | 8/1992 |
| JP | A-2007-141619 A | 6/2007 |

(Continued)

OTHER PUBLICATIONS

International Search Report of PCT/JP2012/050149, date of mailing Apr. 3, 2012.

*Primary Examiner* — Ross Gushi
(74) *Attorney, Agent, or Firm* — Collard & Roe, P.C.

(57) ABSTRACT

One lane is formed by a combination of two signal pins S and adjacent one or two ground pins G of a connector that handles differential signals. When allocating differential signals to pins staggered in two rows, for pin allocation on the board soldering side, (SGS) is allocated to a left end of a first row to form a first lane and then (SGS) is allocated to odd-numbered lanes and (GSSG) to even-numbered lanes while (GSSG) is allocated to a left end of a second row to form a first lane and then (GSSG) is allocated to odd-numbered lanes and (SGS) to even-numbered lanes.

7 Claims, 7 Drawing Sheets

(56) References Cited

U.S. PATENT DOCUMENTS

| | | | | |
|---|---|---|---|---|
| 7,824,220 | B2 * | 11/2010 | Chen | 439/607.35 |
| 8,007,294 | B2 * | 8/2011 | Tanaka | 439/108 |
| 8,033,840 | B2 * | 10/2011 | Wang et al. | 439/108 |
| 8,506,332 | B2 * | 8/2013 | Sommers et al. | 439/607.34 |
| 8,864,501 | B2 * | 10/2014 | Lin et al. | 439/79 |
| 8,894,443 | B2 * | 11/2014 | Sommers et al. | 439/607.34 |
| 2004/0127091 | A1 * | 7/2004 | Naito et al. | 439/488 |
| 2007/0197064 | A1 * | 8/2007 | Masumoto et al. | 439/108 |
| 2008/0014803 | A1 * | 1/2008 | Kato et al. | 439/733.1 |
| 2009/0181564 | A1 * | 7/2009 | Lapidot et al. | 439/108 |
| 2009/0191733 | A1 | 7/2009 | Tanaka | |
| 2009/0203261 | A1 * | 8/2009 | Ikegami et al. | 439/628 |
| 2010/0210124 | A1 * | 8/2010 | Li | 439/108 |
| 2011/0034079 | A1 * | 2/2011 | Nagata et al. | 439/607.01 |
| 2011/0201215 | A1 * | 8/2011 | Matsubara et al. | 439/55 |
| 2012/0122348 | A1 * | 5/2012 | Cho et al. | 439/660 |
| 2013/0196550 | A1 * | 8/2013 | Casher et al. | 439/660 |
| 2013/0252471 | A1 * | 9/2013 | Wu et al. | 439/630 |
| 2013/0337663 | A1 * | 12/2013 | Shiratori et al. | 439/55 |
| 2014/0194005 | A1 * | 7/2014 | Little et al. | 439/607.28 |

FOREIGN PATENT DOCUMENTS

| | | | |
|---|---|---|---|
| JP | A-2008-041656 | A | 2/2008 |
| JP | A-2009-181733 | A | 8/2009 |

* cited by examiner

CONNECTOR

CROSS REFERENCE TO RELATED APPLICATIONS

This application is the National Stage of PCT/JP2012/050149 filed on Jan. 6, 2012, which claims priority under 35 U.S.C. §119 of Japanese Application No. 2011-092067 filed on Apr. 18, 2011, the disclosure of which is incorporated by reference. The international application under PCT article 21(2) was not published in English.

TECHNICAL FIELD

This invention relates to a connector that can be used for connecting lines adapted to transmit differential signals (hereinafter may also be referred to as a "differential signal connector").

BACKGROUND ART

There is known a differential transmission system that allocates a differential signal pair, comprising signals having opposite phases, to two signal lines forming a pair. Since the differential transmission system has a feature that a high data transfer rate can be achieved, it has recently been put to practical use in various fields. In the case of using the differential transmission system, a differential signal connector is used for connecting lines adapted to transmit differential signals. The differential signal connector has a connector fitting side for fitting to a mating connector and a board soldering side for connection to a board of a device or a liquid crystal display.

This type of connector is disclosed in JP-A-2008-41656 and has a plurality of signal pins and a plurality of ground pins. Allocation of these signal pins and ground pins will be described with reference to FIGS. 9 and 10. In FIGS. 9 and 10, S+ represents a signal pin allocated with a positive phase signal of differential signals, S− represents a signal pin allocated with a negative phase signal of differential signals, and G represents a ground pin allocated with ground. In the following description, each signal pin may also be referred to as S without discrimination.

Referring to FIG. 9, on the connector fitting side 1, signal pins S+, signals pins S−, and ground pins G are arranged in a single row. Specifically, (GSSG) is allocated to a left end and then (SSG) is repeatedly allocated.

On the other hand, on the board soldering side 2, signal pins S+, signals pins S−, and ground pins G are, as a whole, staggered in two rows. Specifically, (GSSG) is allocated to a left end of the upper row in the figure and then (SSG) is repeatedly allocated while only (SGS) is repeatedly allocated to the lower row in the figure.

Referring to FIG. 10, on the board soldering side 2, signal pins S+, signals pins S−, and ground pins G are, as a whole, staggered in two rows. Specifically, (GSSG) is allocated to a left end of the upper row on the board soldering side 2 in the figure and then (SSG) is repeatedly allocated while a dummy pin or a ground pin is allocated to a left end of the lower row on the board soldering side 2 in the figure and then pins are allocated in the same manner as in the upper row.

SUMMARY OF THE INVENTION

Problem to be Solved by the Invention

In the following description, a combination of two signal pins S and adjacent one or two ground pins G is counted as one lane. Adjacent lanes may overlap each other by sharing a ground pin G.

In either of FIGS. 9 and 10, on the connector fitting side 1, since (GSSG) Lanes are arranged in one row, ground pins G are inevitably disposed on both sides of two signal pins S in each lane. Therefore, excellent electrical performance can be expected. However, since all the signal pins S and ground pins G are arranged in the single row, it is difficult to make small the lateral dimension of the connector fitting side 1.

On the other hand, on the board soldering side 2, since all the signal pins S and ground pins G are staggered in two rows, it is easy to design the lateral dimension of the board soldering side 2 to be small or to design the dimension between the pins to be large, compared to those on the connector fitting side 1.

However, with the allocation on the board soldering side 2 in FIG. 9, the signal pins S of the adjacent lanes are adjacent to each other in the lower row in the figure and therefore crosstalk tends to occur. On the other hand, with the allocation on the board soldering side 2 in FIG. 10, since the Lane pitch is offset due to the ground pin G at the left end of the upper row in the figure, the extra pin (dummy pin or ground pin) that does not form a lane should be allocated also to the left end of the lower row in the figure and therefore there is no alternative but to increase the size of the connector or reduce the number of lanes. If the number of lanes is reduced, the pin utilization efficiency decreases. Accordingly, the crosstalk characteristics and the pin utilization efficiency are in a trade-off relationship.

It is therefore an object of this invention to provide a small-sized connector capable of improving the crosstalk characteristics and the pin utilization efficiency when handling differential signals.

Means for Solving the Problem

According to an aspect of the present invention, there is provided a connector that allocates differential signals to pins staggered in two rows, wherein a combination of two signal pins (S) and adjacent one or two ground pins (G) forms one lane, and wherein, for pin allocation on a connector fitting side, (SGS) is allocated to an end portion of a first row to form a first lane and then (SGS) is allocated to odd-numbered lanes and (GSSG) to even-numbered lanes, and (GSSG) is allocated to an end portion of a second row to form a first lane and then (GSSG) is allocated to odd-numbered lanes and (SGS) to even-numbered lanes.

According to another aspect of the present invention, there is provided a connector that allocates differential signals to pins staggered in two rows, wherein a combination of two signal pins (S) and adjacent one or two ground pins (G) forms one lane, and wherein, for pin allocation on a board soldering side, (SGS) is allocated to an end portion of a first row to form a first lane and then (SGS) is allocated to odd-numbered lanes and (GSSG) to even-numbered lanes, and (GSSG) is allocated to an end portion of a second row to form a first lane and then (GSSG) is allocated to odd-numbered lanes and (SGS) to even-numbered lanes.

According to still another aspect of the present invention, there is provided a signal line allocation method for allocating differential signals to pins, staggered in two rows, of a connector, wherein a combination of two signal pins (S) and adjacent one or two ground pins (G) forms one lane, and wherein, for pin allocation on a connector fitting side, (SGS) is allocated to an end portion of a first row to form a first lane and then (SGS) is allocated to odd-numbered lanes and (GSSG) to even-numbered lanes, and (GSSG) is allocated to an end portion of a second row to form a first lane and then (GSSG) is allocated to odd-numbered lanes and (SGS) to even-numbered lanes.

According to yet another aspect of the present invention, there is provided a signal line allocation method for allocating differential signals to pins staggered in two rows, wherein a combination of two signal pins (S) and adjacent one or two ground pins (G) forms one lane, and wherein, for pin allocation on a board soldering side, (SGS) is allocated to an end portion of a first row to form a first lane and then (SGS) is allocated to odd-numbered lanes and (GSSG) to even-numbered lanes, and (GSSG) is allocated to an end portion of a second row to form a first lane and then (GSSG) is allocated to odd-numbered lanes and (SGS) to even-numbered lanes.

According to a further aspect of the present invention, there is provided a connector in which a plurality of pins are staggered in two rows on at least a board soldering side and signals and ground are allocated to the pins, wherein the connector includes a first kind of lane (SGS) comprising two signal pins (S) allocated with the signals and one ground pin (G) arranged therebetween and allocated with the ground and a second kind of lane (GSSG) comprising two ground pins (G) allocated with the ground and two signal pins (S) serially arranged therebetween and allocated with the signals, and wherein, on the board soldering side, the first kind of lane (SGS) and the second kind of lane (GSSG) are alternately arranged in each of the two rows and are offset in position between the rows.

Effect of the Invention

According to the above-mentioned respective aspects of this invention, it is possible to provide a small-sized connector capable of improving the crosstalk characteristics and the pin utilization efficiency when handling differential signals.

MODE FOR CARRYING OUT THE INVENTION

First, referring to FIG. 1, the overall structure of a connector according to an embodiment of this invention will be described.

Figure 1:
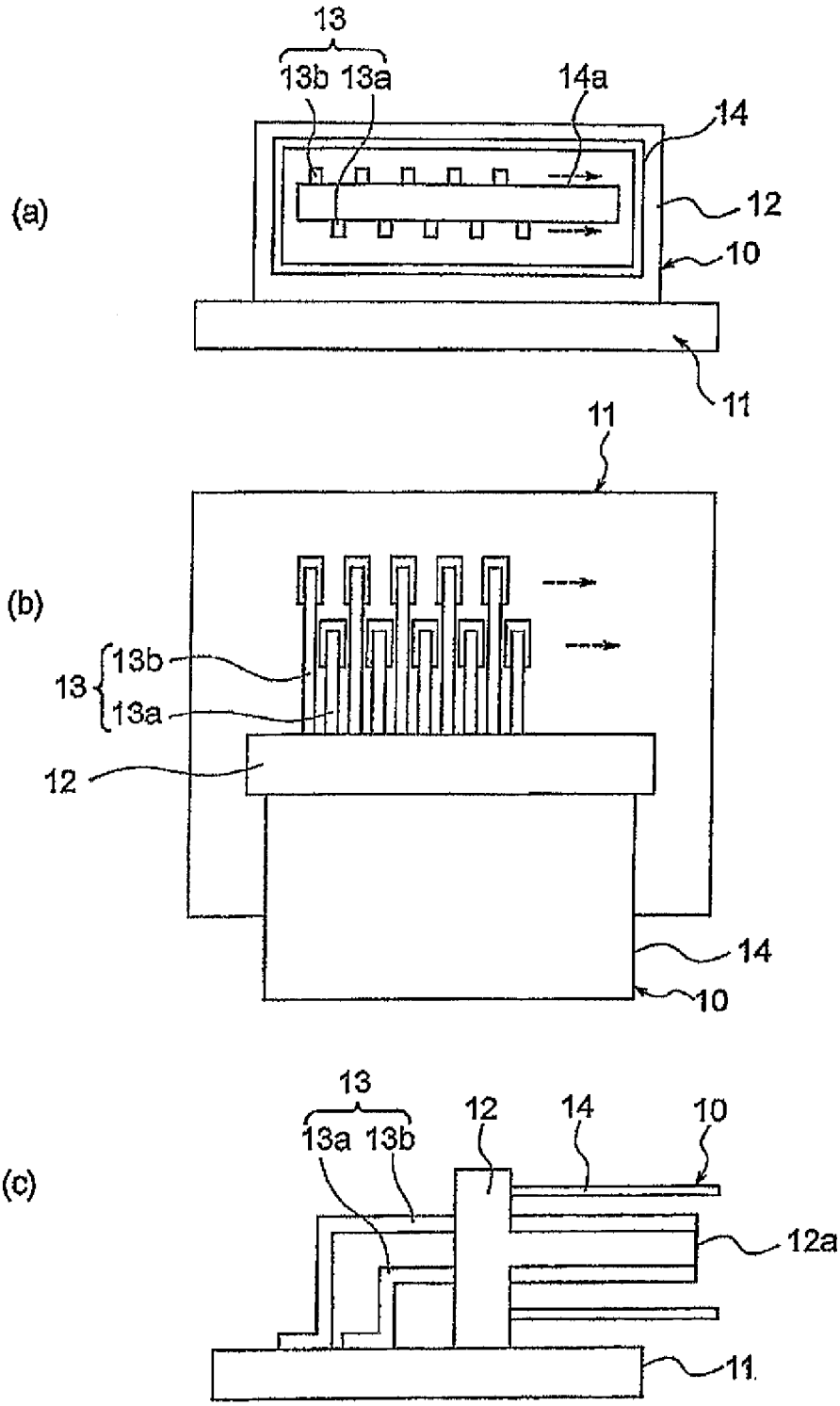
FIG. 1 shows a state where a connector according to an embodiment of this invention is mounted on a board, wherein (a) is a front view, (b) is a top view, and (c) is a left side view.

A connector 10 of FIG. 1 is a differential signal connector mounted on a board 11 and comprises an insulating housing 12, a number of conductive contacts or pins 13 parallel to each other and held by the housing 12, and a conductive shell 14 partially surrounding an outer peripheral surface of the housing 12. The side, adapted to be fitted to a mating connector (not illustrated), of the connector 10 will be referred to as a connector fitting side (see FIG. 1, (a)) while the side, adapted to be connected to the board 11, of the connector 10 will be referred to as a board soldering side (see FIG. 1, (b)). In the figure, only some of the pins 13 are illustrated and the others are given by broken-line arrows to omit illustration thereof.

A number of the pins 13 are divided into a plurality of first-row pins 13*a* disposed on a lower surface of a connector fitting side portion 12*a* of the housing 12 and a plurality of second-row pins 13*b* disposed on an upper surface of the connector fitting side portion 12*a*. On the board soldering side, each first-row pin 13*a* is exposed from the housing 12, then bent perpendicularly, and then soldered to the board 11 at a position relatively close to the housing 12. On the other hand, on the board soldering side, each second-row pin 13*b* is exposed from the housing 12, then bent perpendicularly, and then soldered to the board 11 at a position relatively far from the housing 12. In this manner, on each of the connector fitting side and the board soldering side, a number of the pins 13 are staggered in two rows.

Figure 2:
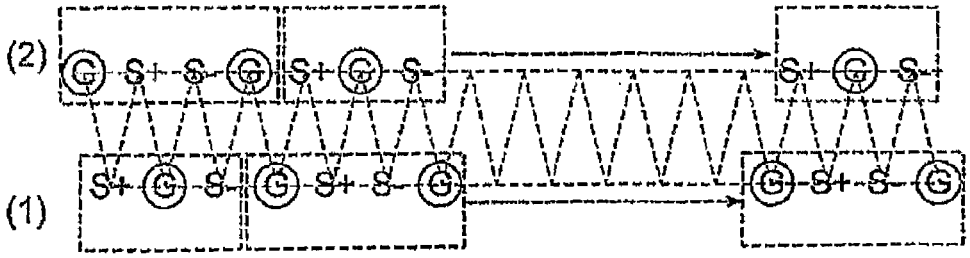
FIG. 2 is an explanatory diagram showing one example of allocation of differential signals and ground to pins of the connector of FIG. 1.
Figure 3:
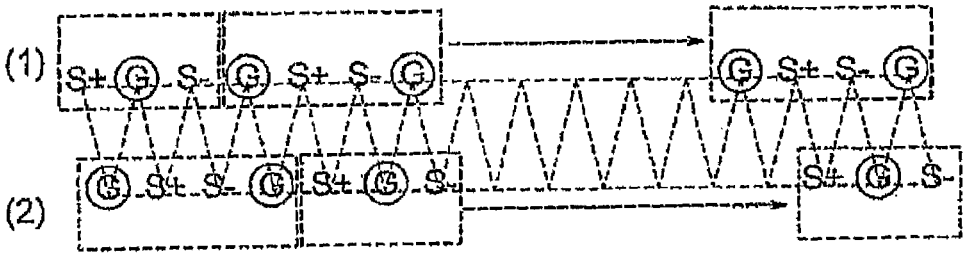
FIG. 3 is an explanatory diagram showing another example of allocation of differential signals and ground to pins of the connector of FIG. 1 (pin allocation in which a first row (1) and a second row (2) in FIG. 2 are vertically reversed).

Next, allocation of differential signals to the pins 13, staggered in two rows, of the connector 10 shown in FIG. 1 will be described with reference to FIGS. 2 and 3. In FIGS. 2 and 3, S+ represents a signal pin allocated with a positive phase signal of differential signals, S− represents a signal pin allocated with a negative phase signal of differential signals, and G represents a ground pin allocated with ground. In the following description, each signal pin may also be referred to as S without discrimination. Since the same allocation is repeated at an intermediate portion, broken-line arrows are used to omit illustration thereof.

In an allocation example shown in FIG. 2, a combination of two signal pins S and adjacent one or two ground pins G forms one lane. Signal pins S and a ground pin G or ground pins G forming each lane are surrounded by a broken-line frame so as to be specified.

When allocating differential signals to the pins staggered in two rows, for pin allocation on the connector fitting side, (S+, G, S−) is allocated to a left end of a first row (1) to form a first lane and then (S+, G, S−) is allocated to odd-numbered lanes and (G, S+, S−, G) to even-numbered lanes while (G, S+, S−, G) is allocated to a left end of a second row (2) to form a first lane and then (G, S+, S−, G) is allocated to odd-numbered lanes and (S+, G, S−) to even-numbered lanes.

The same allocation can be carried out also for pin allocation on the board soldering side. That is, (S+, G, S−) is allocated to a left end of a first row (1) to form a first lane and then (S+, G, S−) is allocated to odd-numbered lanes and (G, S+, S−, G) to even-numbered lanes while (G, S+, S−, G) is allocated to a left end of a second row (2) to form a first lane and then (G, S+, S−, G) is allocated to odd-numbered lanes and (S+, G, S−) to even-numbered lanes.

Figure 9:
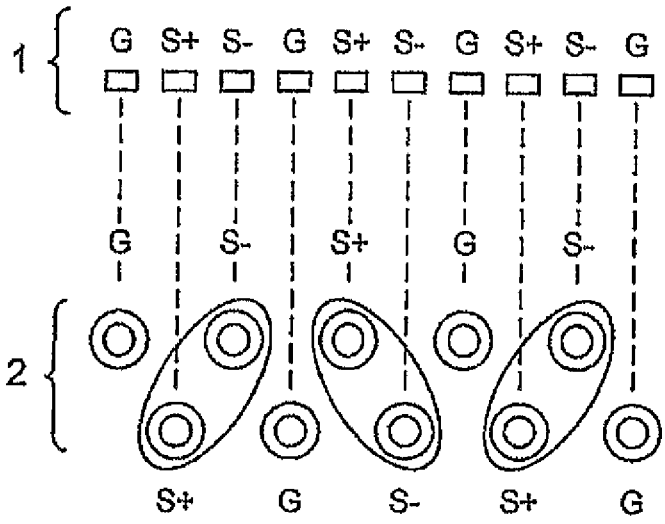
FIG. 9 is an explanatory diagram of one example of allocation of signal pins and ground pins which is disclosed in Patent Document 1 (JP-A-2008-41656).
Figure 10:
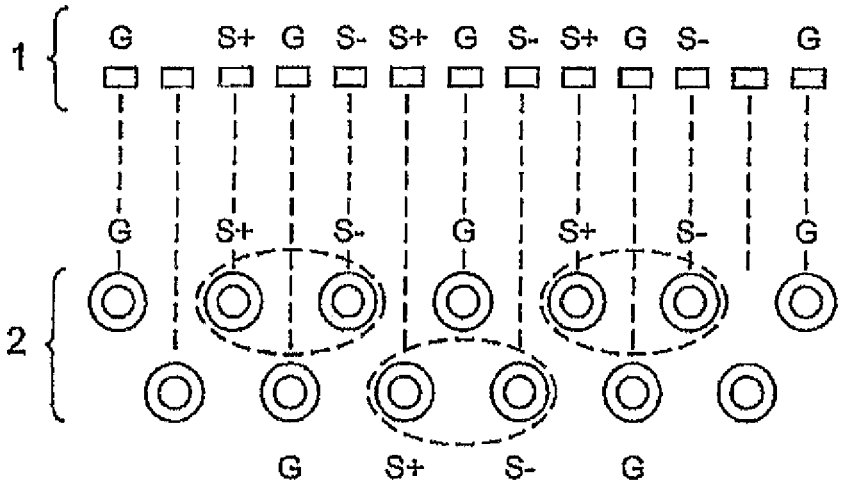
FIG. 10 is an explanatory diagram of another example of allocation of signal pins and ground pins which is disclosed in Patent Document 1.

According to the allocation example shown in FIG. 2, the lanes do not overlap each other and the ground pin G is, without exception, present between the signal pins S of the adjacent lanes. Consequently, crosstalk decreases compared to that on the board soldering side described with reference to FIG. 9. Further, since the allocation is completed by the lane units, the pin utilization efficiency increases compared to that on the board soldering side described with reference to FIG. 10. Naturally, since the differential signals are allocated to the pins staggered in two rows, the lateral dimension of the connector fitting side can be easily reduced. Of the two signal pins S+ and S− in the lane at the leftmost end of the first row (1), the two ground pins G are adjacent to one (S+) of them while the three ground pins G are adjacent to the other (S−). However, since the difference therebetween is 2:3 at most in terms of the number of the ground pins G, the influence is small.

Also in an allocation example shown in FIG. 3 (the arrangement of the second row (2) is allocated to the first-row pins 13*a* while the arrangement of the first row (1) is allocated to the second-row pins 13*b*), a combination of two signal pins S and adjacent one or two ground pins G forms one lane. Signal pins S and a ground pin G or ground pins G forming each lane are surrounded by a broken-line frame so as to be specified.

When allocating differential signals to the pins staggered in two rows, for pin allocation on the connector fitting side, (S+, G, S−) is allocated to a left end of a first row (1) to form a first lane and then (S+, G, S−) is allocated to odd-numbered lanes and (G, S+, S−, G) to even-numbered lanes while (G, S+, S−, G) is allocated to a left end of a second row (2) to form a first lane and then (G, S+, S−, G) is allocated to odd-numbered lanes and (S+, G, S−) to even-numbered lanes. In this case, the allocation is carried out so that triangular pin allocation particularly at the left ends becomes (S-G-G).

The same allocation can be carried out also for pin allocation on the board soldering side. That is, (S+, G, S−) is allocated to a left end of a first row (1) to form a first lane and then (S+, G, S−) is allocated to odd-numbered lanes and (G, S+, S−, G) to even-numbered lanes while (G, S+, S−, G) is allocated to a left end of a second row (2) to form a first lane and then (G, S+, S−, G) is allocated to odd-numbered lanes and (S+, G, S−) to even-numbered lanes. Also in this case, the allocation is carried out so that triangular pin allocation particularly at the left ends becomes (S-G-G).

According to the allocation example shown in FIG. 3, the lanes do not overlap each other and the ground pin G is, without exception, present between the signal pins S of the adjacent lanes. Consequently, crosstalk decreases compared to that on the board soldering side described with reference to FIG. 9. Further, since the allocation is completed by the lane units, the pin utilization efficiency increases compared to that on the board soldering side described with reference to FIG. 10. Naturally, since the differential signals are allocated to the pins staggered in two rows, the lateral dimension of the connector fitting side can be easily reduced. Further, there is also an advantage that the number of the ground pins G adjacent to the signal pin S is standardized to two in all the lanes.

The connector 10 of FIG. 1 can also be described such that the pins 13 are staggered in two rows on at least the board soldering side and that signals and ground are allocated to these pins 13 in a manner described below.

In this case, the connector 10 includes a first kind of lane (SGS) comprising two signal pins S allocated with signals and one ground pin G arranged therebetween and allocated with ground and a second kind of lane (GSSG) comprising two ground pins G allocated with ground and two signal pins S serially arranged therebetween and allocated with signals. On the board soldering side, it is configured such that the first kind of lane (SGS) and the second kind of lane (GSSG) are alternately arranged in each of the first row (1) and the second row (2) and are offset in position between the rows.

Particularly in the case of the allocation example shown in FIG. 2, triangular pin allocation at the left ends is (G-S-S), i.e. one ground pin G and one signal pin S+ of the second kind of lane (GSSG) arranged in the second row (2) and one signal pin S+ of the first kind of lane (SGS) arranged in the first row (1) are located at vertices of a triangle, respectively.

In the case of the allocation example shown in FIG. 3, triangular pin allocation at the left ends is (S-G-G), i.e. one signal pin S+ and one ground pin G of the first kind of lane (SGS) arranged in the first row (1) and one ground pin G of the second kind of lane (GSSG) arranged in the second row (2) are located at vertices of a triangle, respectively.

Figure 4:
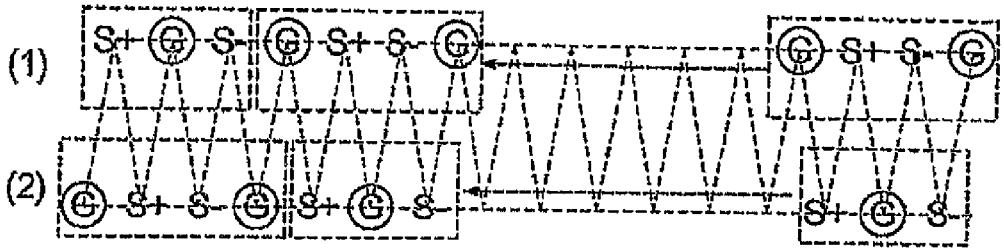
FIG. 4 is an explanatory diagram showing a modification of FIG. 2.

In FIG. 2, the lanes are arranged from the left end in each of the first row (1) and the second row (2), However, as shown in FIG. 4, lanes may be arranged from a right end in each of a first row (1) and a second row (2).

Figure 5:
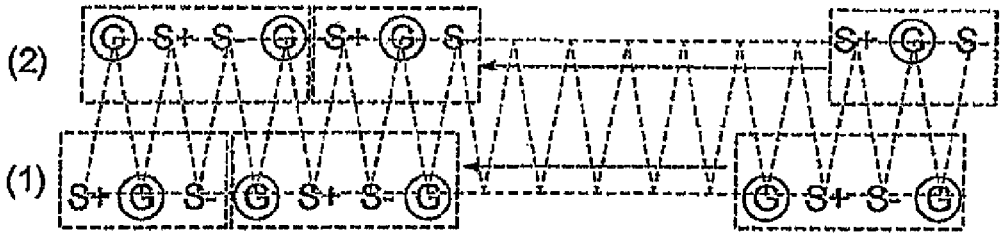
FIG. 5 is an explanatory diagram showing a modification of FIG. 3.

Likewise, while the lanes are arranged from the left end in each of the first row (1) and the second row (2) in FIG. 3, lanes may be arranged from a right end in each of a first row (1) and a second row (2) as shown in FIG. 5.

Figure 6:
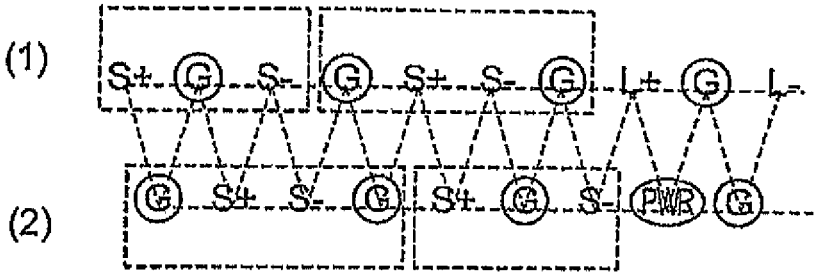
FIG. 6 is an explanatory diagram showing an example in which, in addition to differential signals and ground, a power supply, low-speed signals, and so on are allocated to pins of the connector of FIG. 1.

In the above-mentioned various examples, the first row (1) and the second row (2) are formed only by the lanes. However, in addition to the signal pins S+ and S− and the ground pins G for differential signals, terminals or pins for handling signals, a power supply, and so on not directly related to differential signals may be provided. For example, as shown in FIG. 6, signal pins L+ and L− and ground pins G for low-speed signals and power supply terminals PWR for bus power may be added on the right end side of each of the first row (1) and the second row (2).

The additional terminals or pins may be provided in at least one of the first row (1) and the second row (2) on at least one of the right end side and the left end side thereof. The additional terminals or pins may be interposed between the lanes.

Next, referring to FIG. 7, the relationship between the number of lanes and the number of pins allocated with ground will be described.

Figure 7:
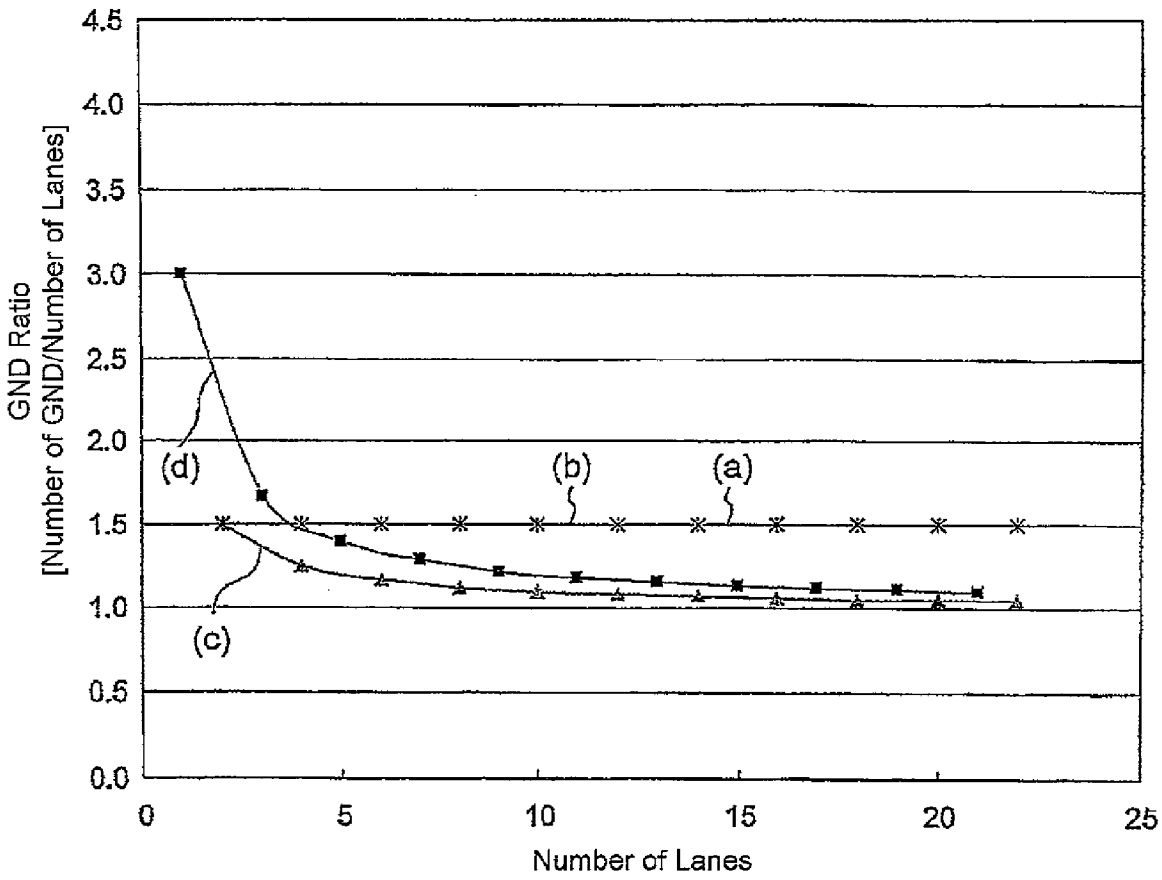
FIG. 7 is a graph showing relationships between the number of lanes each as a gathering of pins and the number of pins allocated with ground.

In a graph of FIG. 7, the ordinate axis represents the GNB ratio (number of ground pins/number of lanes) while the abscissa axis represents the number of lanes. Herein, "the number of lanes" represents "the number of repetition of a lane after the second inclusive". The first lane is not counted. Since the same number of lanes are arranged in a first row and a second row, the number of lanes is an even number. (a) represents the case of the allocation example shown in FIG. 2, (b) represents the case of the allocation example shown in FIG. 3, (c) represents the case of the allocation on the board soldering side in FIG. 9, and (d) represents the case of the allocation on the board soldering side in FIG. 10.

In (c) and (d), the GND ratio changes according to the number of lanes. On the other hand, in (a) and (b), the GND ratio is constant regardless of the number of lanes.

Further, referring to FIG. 8, the relationship between the number of lanes and the space efficiency will be described.

Figure 8:
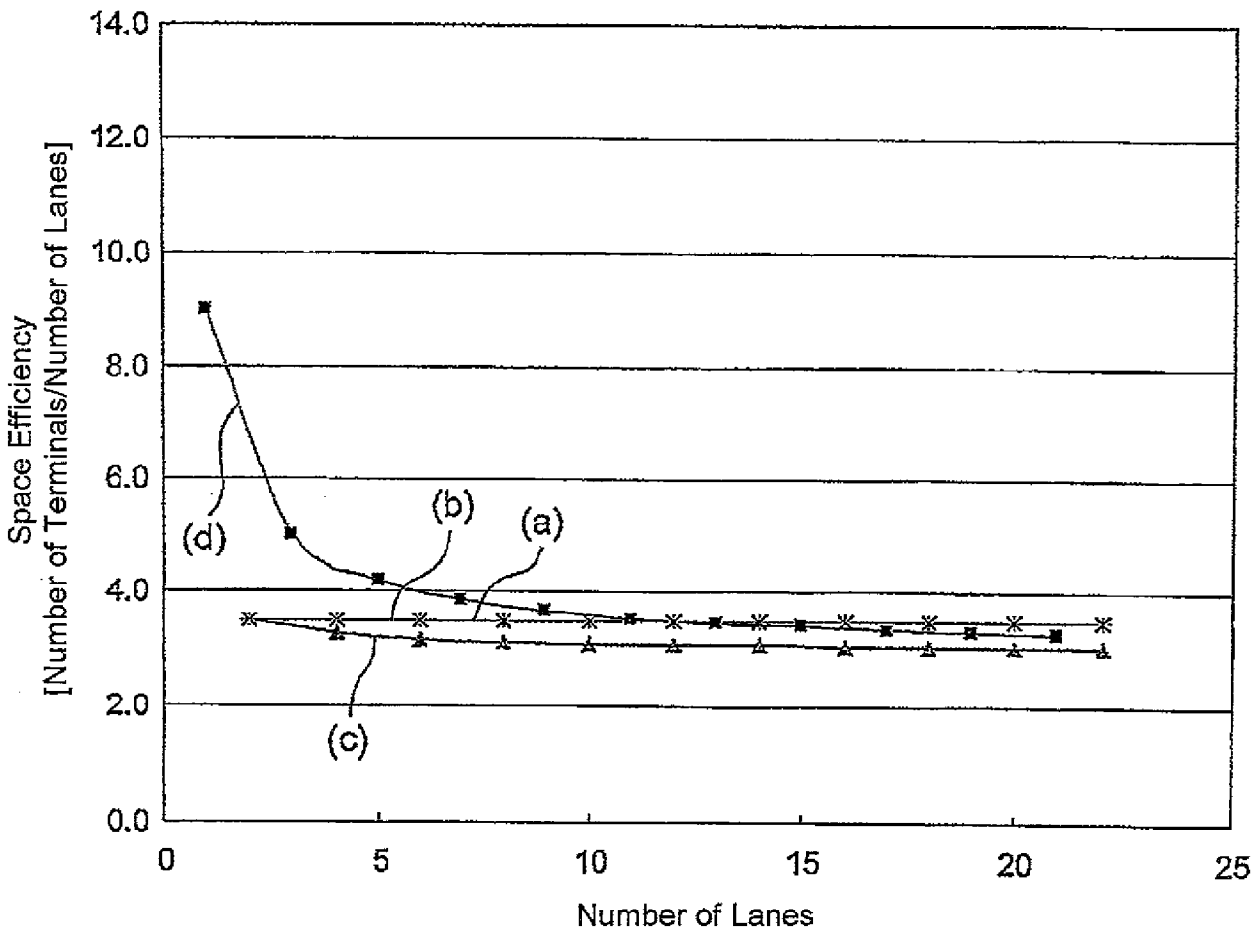
FIG. 8 is a graph showing relationships between the number of lanes and the space efficiency.

In a graph of FIG. 8, the ordinate axis represents the space efficiency (number of pins/number of lanes) while the abscissa axis represents the number of lanes. (a) represents the case of the allocation example shown in FIG. 2, (b) represents the case of the allocation example shown in FIG. 3, (c) represents the case of the allocation on the board soldering side in FIG. 9, and (d) represents the case of the allocation on the board soldering side in FIG. 10.

In (c) and (d), the space efficiency changes as the number of lanes decreases. On the other hand, in (a) and (b), the space efficiency is constant regardless of the number of lanes. In the graph, (a) and (b) overlap each other.

This invention is not limited to the above-mentioned embodiments. While part or the whole of the above-mentioned embodiments can also be described as the following supplementary notes, these supplementary notes do not limit the scope of this invention.

(Supplementary note 1) A connector that allocates differential signals to pins staggered in two rows, wherein a combination of two signal pins (S) and adjacent one or two ground pins (G) forms one lane, and wherein, for pin allocation on a connector fitting side, (SGS) is allocated to an end portion of a first row to form a first lane and then (SGS) is allocated to odd-numbered lanes and (GSSG) to even-numbered lanes, and (GSSG) is allocated to an end portion of a second row to form a first lane and then (GSSG) is allocated to odd-numbered lanes and (SGS) to even-numbered lanes.

(Supplementary note 2) The connector according to supplementary note 1, wherein triangular pin allocation particularly at the end portions is (S-G-G) on the connector fitting side.

(Supplementary note 3) A connector that allocates differential signals to pins staggered in two rows, wherein a combination of two signal pins (5) and adjacent one or two ground pins (G) forms one lane, and wherein, for pin allocation on a board soldering side, (SGS) is allocated to an end portion of a first row to form a first lane and then (SGS) is allocated to odd-numbered lanes and (GSSG) to even-numbered lanes, and (GSSG) is allocated to an end portion of a second row to form a first lane and then (GSSG) is allocated to odd-numbered lanes and (SGS) to even-numbered lanes.

(Supplementary note 4) The connector according to supplementary note 3, wherein triangular pin allocation particularly at the end portions is (S-G-G) on the board soldering side.

(Supplementary note 5) A signal line allocation method for allocating differential signals to pins, staggered in two rows, of a connector, wherein a combination of two signal pins (S) and adjacent one or two ground pins (G) forms one lane, and wherein, for pin allocation on a connector fitting side, (SGS) is allocated to an end portion of a first row to form a first lane and then (SGS) is allocated to odd-numbered lanes and (GSSG) to even-numbered lanes, and (GSSG) is allocated to an end portion of a second row to form a first lane and then (GSSG) is allocated to odd-numbered lanes and (SGS) to even-numbered lanes.

(Supplementary note 6) The signal line allocation method according to supplementary note 5, wherein triangular pin allocation particularly at the end portions is (S-G-G) on the connector fitting side.

(Supplementary note 7) A signal line allocation method for allocating differential signals to pins staggered in two rows, wherein a combination of two signal pins (3) and adjacent one or two ground pins (G) forms one lane, and wherein, for pin allocation on a board soldering side, (SGS) is allocated to an end portion of a first row to form a first lane and then (SGS) is allocated to odd-numbered lanes and (GSSG) to even-numbered lanes, and (GSSG) is allocated to an end portion of a second row to form a first lane and then (GSSG) is allocated to odd-numbered lanes and (SGS) to even-numbered lanes.

(Supplementary note 8) The signal line allocation method according to supplementary note 7, wherein triangular pin allocation particularly at the end portions is (S-G-G) on the board soldering side.

(Supplementary note 9) A connector in which a plurality of pins are staggered in two rows on at least a board soldering side and signals and ground are allocated to the pins, wherein the connector includes a first kind of lane (SGS) comprising two signal pins (S) allocated with the signals and one ground pin (G) arranged therebetween and allocated with the ground and a second kind of lane (GSSG) comprising two ground pins (G) allocated with the ground and two signal pins (S) serially arranged therebetween and allocated with the signals, and wherein, on the board soldering side, the first kind of lane (SGS) and the second kind of lane (GSSG) are alternately arranged in each of the two rows and are offset in position between the rows.

(Supplementary note 10) The connector according to supplementary note 9, wherein the ground pin (G) of the first kind of lane (SGS) arranged in one of the two rows and the two signal pins (S) of the second kind of lane (GSSG) arranged in the other of the two rows are located at vertices of a triangle, respectively.

(Supplementary note 11) The connector according to supplementary note 9, wherein one of the two signal pins (S) of the first kind of lane (SGS) arranged in one of the two rows and the two signal pins (S) of the second kind of lane (GSSG) arranged in the other of the two rows are located at vertices of a triangle, respectively.

While the description has been made with reference to the specific embodiments, various modifications can be made thereto. It goes without saying that those modifications are also included in this invention.

DESCRIPTION OF SYMBOLS

1 connector fitting side
2 board soldering side
10 connector
11 board
12 housing
12*a* connector fitting side portion
13 contact or pin
13*a* first-row pin
13*b* second-row pin
14 shell
S signal pin
S+ signal pin allocated with a positive phase signal of differential signals
S− signal pin allocated with a negative phase signal of differential signals
G ground pin
(SGS) first kind of lane
(GSSG) second kind of lane

The invention claimed is:

1. A method for connecting differential signal lines and ground to pins, staggered in a first row and a second row which are parallel to each other, of a connector, the pins comprising signal pins (S) connected to the differential signal lines and ground pins (G) connected to the ground, the method comprising:

combining two of the signal pins (S) and adjacent one or two of the ground pins (G) to form an (SGS) lane, in which one ground pin (G) is arranged between two signal pins (S), and a (GSSG) lane, in which two signal pins (S) are serially arranged between two ground pins (G), and wherein, for pin arrangement on a connector fitting side of the connector, on the first row, arranging the (SGS) lane in an end portion of the first row and then repeatedly arranging the (GSSG) and (SGS) lanes in this order next to the (SGS) lane that is arranged in the end portion of the first row, and on the second row, arranging the (GSSG) lane in an end portion of the second row and then repeatedly arranging the (GSSG) and (SGS) lanes in this order next to the (SGS) lane that is arranged in the end portion of the second row.

2. The method according to claim 1, further comprising locating one of the signal pins (S) and two of the ground pins (G) at vertices of a triangle, respectively, to form a triangular pin arrangement.

3. A method for connecting differential signal lines and ground to pins staggered in a first row and a second row which are parallel to each other, of a connector, the pins comprising signal pins (S) connected to the differential signal lines and ground pins (G) connected to the ground, the method comprising:

combining two of the signal pins (S) and adjacent one or two of the ground pins (G) to form an (SGS) lane, in which one ground pin (G) is arranged between two signal pins (S), and a (GSSG) lane, in which two signal pins (S) are serially arranged between two ground pins (G), and wherein, for pin arrangement on a board soldering side of the connector, on the first row, arranging the (SGS) lane to an end portion of the first row repeatedly arranging the (GSSG) and (SGS) lanes in this order next to the (SGS) lane that is arranged in the end portion of the first row, and on the second row, arranging the (GSSG) lane to an end portion of the second row and then repeatedly arranging the (SGS) and the (GSSG) lanes in this order next to the (GSSG) lane that is arranged in the end portion of the second row.

4. The method according to claim 3, further comprising locating one of the signal pins (S) and two of the ground pins (G) at vertices of a triangle, respectively, to form a triangular pin arrangement.

5. A method of using a connector comprising a plurality of pins staggered in two rows on at least a board soldering side of the connector, the pins comprising signal pins (S) and ground pins (G), the method comprising:

including in the connector:

a first kind of lane (SGS) comprising two of the signal pins (S) connected to signal lines and one of the ground pins (G) arranged between the two of the signal pins (S) and connected to ground; and a second kind of lane (GSSG) comprising two of the ground pins (G) connected to the ground and two of the signal pins (S) serially arranged between the two of the ground pins (G) and connected to the signal lines, and on the board soldering side, arranging the first kind of lane (SGS) and the second kind of lane (GSSG) alternately in each of the two rows and offset in position between the rows.

6. The method according to claim 5, wherein the ground pin (G) of the first kind of lane (SGS) arranged in one of the two rows and the two signal pins (S) of the second kind of lane (GSSG) arranged in the other of the two rows are located at vertices of a triangle, respectively.

7. The method according to claim 5, wherein one of the two signal pins (S) of the first kind of lane (SGS) arranged in one of the two rows and the two signal pins (S) of the second kind of lane (GSSG) arranged in the other of the two rows are located at vertices of a triangle, respectively.

* * * * *